United States Patent [19]

Jones

[11] Patent Number: 4,977,629

[45] Date of Patent: Dec. 18, 1990

[54] PORTABLE INFLATABLE PATIENT ASSIST APPARATUS

[76] Inventor: Betty J. Jones, Rte. 1 Box 394, Crestview, Fla. 32536

[21] Appl. No.: 478,473

[22] Filed: Feb. 12, 1990

Related U.S. Application Data

[63] Continuation of Ser. No. 168,157, Mar. 15, 1988, abandoned.

[51] Int. Cl.[5] ..... A61G 7/04

[52] U.S. Cl. ..... 5/61; 5/90; 5/455; 5/431

[58] Field of Search ..... 5/61, 90, 431, 436, 5/491, 496, 453, 455, 456, 458; 4/451, 457

[56] References Cited

U.S. PATENT DOCUMENTS

| | | | |
|---|---|---|---|
| 1,981,666 | 11/1934 | Ridley | 4/456 X |
| 3,477,071 | 11/1969 | Emerson | 5/61 |
| 3,935,604 | 2/1976 | Collins | 5/61 X |
| 4,005,498 | 2/1977 | Starr et al. | 5/455 X |
| 4,207,633 | 6/1980 | Smith et al. | 5/90 |
| 4,309,783 | 1/1982 | Cammack et al. | 5/453 X |
| 4,472,848 | 9/1984 | Newman | 5/463 |

*Primary Examiner*—Michael F. Trettel

*Attorney, Agent, or Firm*—Pravel, Gambrell, Hewitt, Kimball & Krieger

[57] ABSTRACT

A multi-chambered, normally deflated pad positioned on a bed wherein the bed-ridden person would make contact with the pad in that area of the body between the hips and shoulder. The pad would have first and second inflatable chambers positioned adjacent the bed, which would overlap down a double longitudinal axis. Each chamber would be independent from the second chamber and would be provided with an inlet for pressurized air to be pumped thereinto, for selectively inflating that particular chamber which one wishes to inflate. Following the introduction of air into the chamber, the chamber would slowly inflate exerting force on the portion of the patient directly above it, and since each of the respective chambers are positioned substantially over half of the bed, the patient would be moved or rotated on a rotational axis of any desired angle between the vertical and the horizontal as inflation or deflation is accomplished.

2 Claims, 3 Drawing Sheets

PORTABLE INFLATABLE PATIENT ASSIST APPARATUS

This is a continuation of copending application Ser. No. 168,157, filed Mar. 15, 1988 now abandoned.

BACKGROUND OF THE INVENTION

1. Field of the Invention

The present invention relates to inflatable devices. More particularly, the present invention relates to a portable inflatable device for use on a bed or the like for assisting a bedridden person in executing turns in the bed when the apparatus is inflated on one side or the other. Further, there is included an inflatable portion for lifting a patient's midsection for accommodating a bed-pan beneath the patient with relative ease.

2. General Background

In the present state of the art, individuals who are bedridden due to accidents or illness, and must require extended time in bed, face the daily problem of having to be turned from their back or stomach onto their side in order to be washed or in order that the blood circulation flows properly to these areas in order to prevent bed sores or the like, or in the prevention of pneumonia when a patient is allowed to settle in one position only. At the present time, it requires that at least one or two aides assist in turning patients at certain times during the day and maintaining patients in the position so that the patients may be cleaned or simply rest in that position. Of course, this requires long and tedious man hours in order to accomplish this chore, not withstanding the fact that the patients are unable to accomplish this on their own, and must request that individuals on the hospital staff assist them. Even worse, is the fact that patients who are bedridden at their homes, often times have no one around to assist them in such maneuvers, and thus must either maintain themselves in the position until someone can assist them, or must attempt to contact someone out of their home in order that they may assist them. This of course, is very troublesome, and often times cannot be accomplished, the result being that the patient ends up with inadequate circulation in those areas in constant contact with the bed, and therefore, bed sores and possibly pneumonia result.

Further, an additional problem which is encountered in the present state of the art is the fact that a bed ridden patient must, from time to time, be tended to so that the patient's wastes are properly relieved. Of course, the manner in which this is presently accomplished is the use of a bed-pan which must be affixed beneath the patient in order to collect the wastes. This, often times is a very difficult undertaking and will require several personnel to position the patient properly and often results in mishaps and soiled linen. Patents which may be pertinent to the present invention are listed as follows:

| U.S. Pat. No. | INVENTOR | TITLE |
|---|---|---|
| 3,485,240 | Fountain | "Hospital Bed With Inflation Patient Turning Means" |
| 3,895,403 | Davis | "Patient Orienting Device" |
| 3,477,071 | Emerson | "Device For Automatically Shifting The Body Of A Patient" |
| 3,526,908 | Davis | "Body-Turning Device For A Hospital Patient" |

-continued

| U.S. Pat. No. | INVENTOR | TITLE |
|---|---|---|
| 1,627,835 | Combs | "Pneumatic Bed" |
| 1,981,666 | Ridley | "Bed Lift" |
| 946,831 | O'Halloran | "Improvements In Or Relating To Mattresses" |
| 3,775,781 | Bruno, et al | "Patient Turning Apparatus" |
| 3,935,604 | Collins | "Support Device For Lifting And Supporting Patients" |
| 4,309,783 | Cammack, et al | "Adjustably Conformable Bed" |

SUMMARY OF THE PRESENT INVENTION

The preferred embodiment of the apparatus of the present invention overcomes the shortcomings found in the present state of the art in a straightforward manner, providing an apparatus which would be relatively inexpensive to produce and purchase, simple to manufacture and simple in its operation. What is provided is a multi-chambered, normally deflated pad positioned on a bed wherein the bedridden person would make contact with the pad in that area of the body between the hips and shoulder. The pad would have first and second inflatable chambers positioned adjacent the bed, which would overlap down a double longitudinal axis. Each chamber would be independent from the second chamber and would be provided with an inlet for pressurized air to be pumped thereinto, for selectively inflating that particular chamber one wishes to inflate. Following the introduction of air into the chamber, the chamber would slowly inflate exerting force on the portion of the patient directly above it, and since each of the respective chambers are positioned substantially over half of the bed, the patient would be moved or rotated on a rotational axis to any desired angle between the vertical and the horizontal as inflation or deflation is accomplished.

Further, there is provided an additional chamber provided along the outer most border of the apparatus which is inflatable along its length, and interconnected with an continuous inflatable chamber. The inflatable chamber positioned along an arcuate section of the rump of the patient, so that upon selective and independent inflation, the arcuate portion is inflated so as to provide upward lifting of the patient's rump, to a height substantially at the height of a standard bed-pan, so that the bed-pan may be comfortably positioned within the area defined by the arcuate inflatable portion, thus providing comfortable means for relief of the patient in elimination of waste.

Therefore, it is a primary object of the present invention to provide a multi-chamber pad on a patient's bed for allowing rotational movement of the patient on a longitudinal axis;

It is a further object of the present invention to provide a multi-chambered pad so that inflation of particular chambers provides the uplifting of the patient's rump to sufficient height so that a bed-pan may be inserted therebeneath;

It is still a further object of the present invention to provide an inflatable pad on a patient bed which in the normally deflated state allows the patient to lay substantially prone, but upon selective inflation of various chambers, provides positioning of the patient to facilitate healing of the patient or assist in the elimination of waste by the patient.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 1 is a top view of the preferred embodiment of the apparatus of the present invention illustrating the lower inflatable parallel portions in position on a mattress or the like;

DETAILED DESCRIPTION OF THE PREFERRED EMBODIMENT

Figure 1:
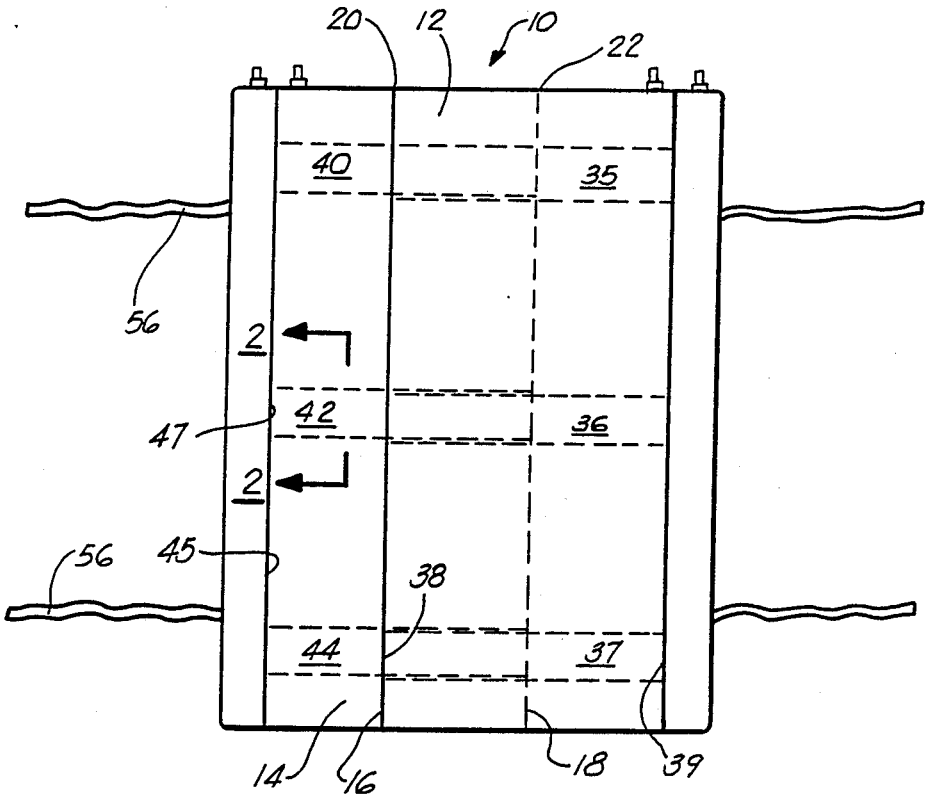

FIGS. 1–6 best illustrate the preferred embodiment of the apparatus of the present invention designated by the numeral 10. For purposes of discussion, an initial discussion will be had of apparatus 10 as it functions in the service of rotating a bed-ridden patient through the pair of spaced apar at inflatable chambers. In this particular use, apparatus 10 would be utilized primarily for assisting in the rotating of a bed-ridden individual from the position on the bed while laying on one's back, or one's stomach, to a position substantially perpendicular to the surface plane of the bed itself. As seen in FIGS. 1 through 4, apparatus 10 comprises inflatable chambers 12 and 14. Both chambers 12 and 14 are substantially identical in nature, and would be connected, preferably through stitching or the like, along a double longitudinal axis 16 and 18, as seen more clearly in FIG. 1. Each chamber 12 and 14, individually, would be capable of being selectively inflated, as the choice may be. As seen in top view in FIG. 1, chambers 12 and 14, normally in the deflated state, are stitched along the double longitudinal axis 16 and 18, and would overlap one another at points 20 and 22, and as seen in FIG. 1, thus creating a single pad apparatus, which may be placed on a mattress 24 and would be substantially a width of a normal person, as illustrated by numeral 26, FIGS. 3 and 4. In the preferred embodiment, apparatus 10 would run substantially the distance of the length of an average individual between the individual's hip region and shoulder region, as illustrated in FIG. 1.

Figure 2:
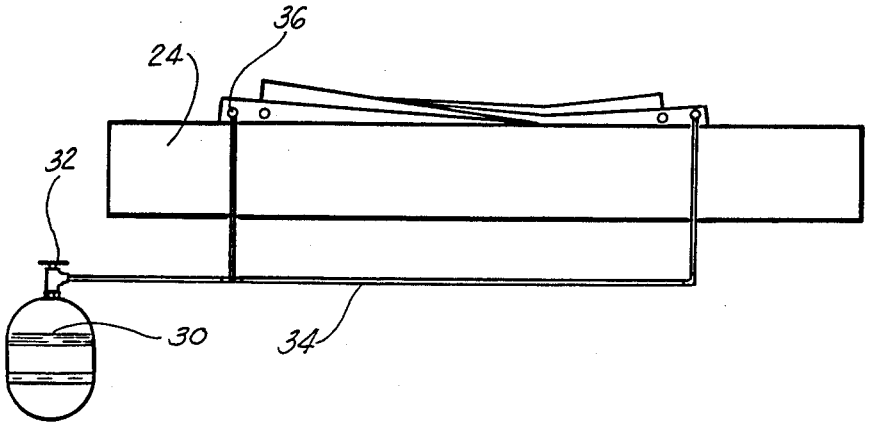
FIG. 2 is an end view of the preferred embodiment of the apparatus of the present invention illustrating the lower parallel chambers in their deflated state.

FIG. 2 illustrates pressurized air source 30, which would be a typical pressurized air tank, with air being pressurized between 30 and 100 lbs. of pressure. As is further illustrated in FIG. 2, pressurized air tank 30 would be equipped with valve 32 for allowing or disallowing, as the case may be, upon rotational movement, the passage of air from tank 30 into line 34 and inlet spout 36, as is illustrated in FIG. 2.

Figure 3:
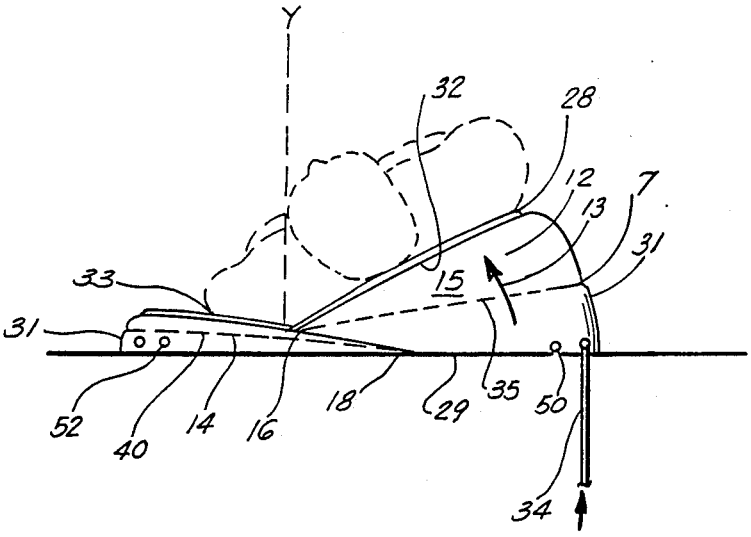
FIG. 3 is an end view of the preferred embodiment of the apparatus of the present invention illustrating the first lower chamber in the inflated state.

Upon passage of pressurized air through inlet spout 36, FIG. 3 illustrates the inflation of air chamber 12, as illustrated by the arrows 13. Before inflation, individual 26 would be basically in the prone position, with the individual's back 28 in surface contact with the deflated apparatus 10, and substantially parallel with the surface of mattress 24. Upon inflation of, for example, air chamber 12, as illustrated in FIG. 3, inflates to form a substantially triangular shaped inflated apparatus, with bottom wall 29 in contact with mattress 24, exterior wall 31, being the most outward wall of the triangular shaped inflated chamber, and wall 32, the innermost wall being in contact with the back 28 of individual 26. As is further illustrated in FIG. 3, shoulder 33 of individual 26 is in contact with deflated chamber 14, and due to the weight of individual 26, maintains apparatus 10 in position on mattress 24 while the opposite chamber, in this case chamber 12 is being inflated. Were that not the case, chamber 12 would simply slide out from under individual 26, and would be totally ineffective. Upon complete of inflation of chamber 12, individual 26 would be substantially on its side, and, could be substantially perpendicular to the horizontal surface of mattress 24.

Figure 4:
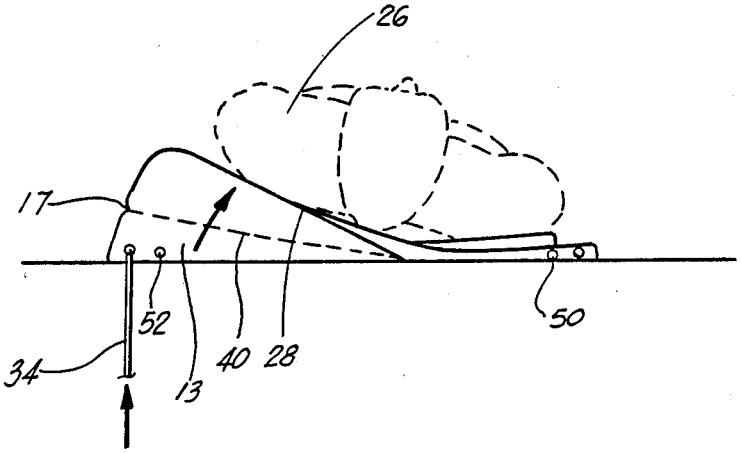
FIG. 4 is an end view of the preferred embodiment of the apparatus of the present invention illustrating the second lower chamber in the inflated state.

Likewise, as seen in FIG. 4, inflation of chamber 14 is accomplished in the same fashion as inflation of chamber 12, in order to rotate individual 26 in the opposite direction.

As is further illustrated in FIG. 1, an additional unique feature of the present apparatus 10, is a plurality of elastic bands 35, 36, and 37, which are placed substantially equidistant apart along the inside of apparatus 10, with bands 35, 36, and 37 being placed within chamber 12, extending from a lower most leading edge of chamber 12 at point 38 and extending to substantially the midpoint of outermost wall 31 at point 39. Likewise, chamber 14 is provided with a plurality of elastic means 40, 42, and 44 which, like elastic means 35 through 37 in chamber 12 also are positioned from leading most edge of chamber 14 to substantially the middle of outermost wall 45 of chamber 14, connecting at point 47 onto wall 45. Therefore, in the deflated state, elastic means 35 and 37 and 40 and 44, in air chambers 12 and 14 respectively, are maintained in the normal, non-stretched state, as seen in FIG. 1. However, upon inflation, as seen in FIG. 3, of chamber 12, for example, elastic means 35 through 37 (with 35 numbered in FIG. 3) would stretch outward in opposition to the inflation of chamber 12 causing the dimpling effect to outermost wall 45, as seen in FIG. 3, and wall 31, as seen in FIG. 4.

Upon deflation of each chamber 12 or 14, elastic means 35 through 37 and 40 through 44 respectively, would retract, thus folding walls 31 and 45 inward to a position as seen in FIG. 1. This, therefore, would maintain apparatus 10 substantially as a rectangular pad in the deflated state, as seen in FIGS. 3 and 4, and would prevent walls 31 and 45 from extending outward in the deflated state. This infolding of walls 31 and 45 is necessary so that upon inflation, walls 31 and 45 would tend to expand out thus moving top wall 32 upward to rotate individual 26 as seen in FIGS. 3 and 4.

As is further illustrated in FIGS. 1 through 4, in order to deflate air chamber 12 and 14, there is further provided release valves 50 and 52. When one would wish to selectively deflate a particular chamber 12 and 14, one would simple rotate the release valves, thus venting the air within chamber 12 or 14 into the atmosphere. There is further illustrated in FIG. 1, retainer straps 56 which would be a typical type of strap for further adhering apparatus 10 onto mattress 24 and could simply wrap around mattress 24 and connect on the lowermost side of mattress 24.

Figure 5:
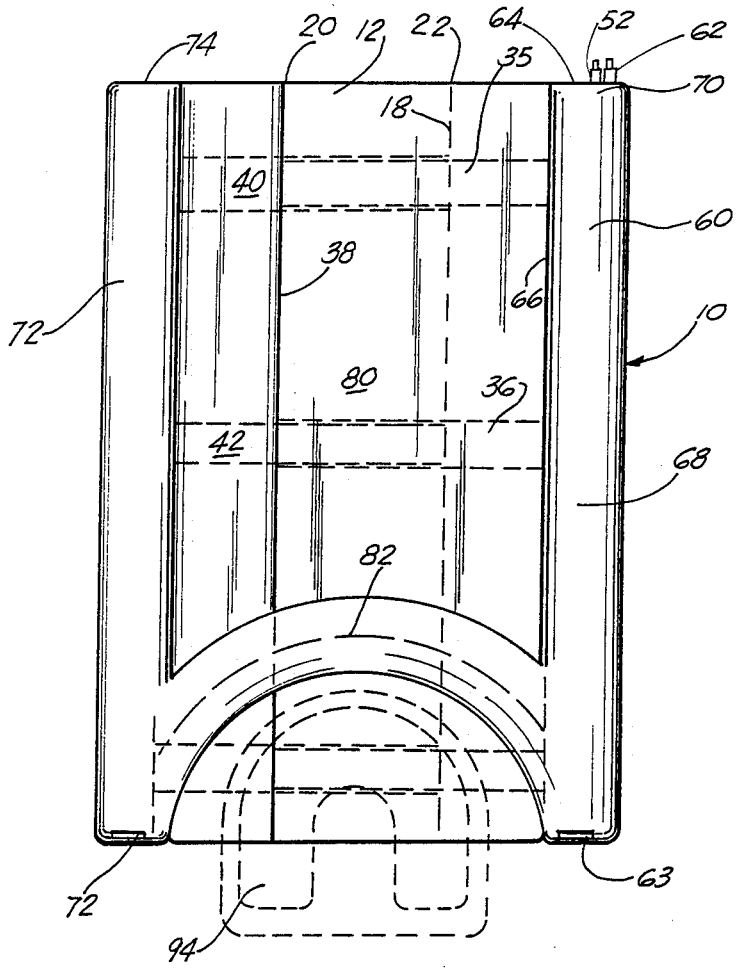
FIG. 5 illustrtes a top view of the upper border chamber set upon the lower first and second chambers in FIG. 1 of the preferred embodiment of the apparatus of the present invention.
Figure 6:
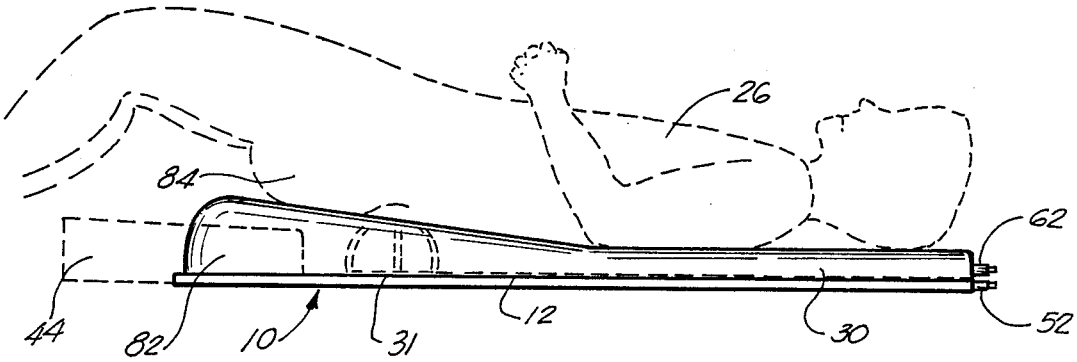
FIG. 6 represents a side partial cut-away view of the inflated border chamber of the preferred embodiment of the apparatus of the present invention with a patient thereupon.

FIGS. 5 and 6 further illustrate the preferred embodiment of the apparatus of the present invention in use as a means for assisting a bed-ridden patient in the elimination of waste while the patient is maintained in the prone position in bed. As seen in the Figures, apparatus 10 would further comprise a continuous upper inflatable chamber 60 which is inflatable through a separate valve 62, in the preferred embodiment the valve located at one end portion 64 of the chamber 60. Chamber 60 would be positioned on top of the inflatable chambers 12 and 14 of apparatus 10 and would provide a first longitudinal leg 68 which would terminate at a first point 70 substantially at the lower portion of apparatus 10. There would likewise be included a second longitudinal leg 72 along the second border of apparatus 10 and would likewise have a first end portion 74 and a first termination point 76 again at the lower point of apparatus 10, the first and second inflatable legs 68 and 72 defining an inflatable perimeter along the two side borders of apparatus 10 and defining a zone 80 intermediate legs 68 and 72 wherein a patient's head, back and shoulder would be located during inflation of the legs 68 and 72. Further, at each second termination point 70 and 74 respectively of legs 68 and 72, thee is provided an interconnecting arcuate inflatable portion 82 which would interconnect and provide a continuous air flow between first leg 68 and second leg 70, so that upon introduction of air into valve 62, the entire apparatus would be inflated as seen in FIG. 5.

As seen in FIG. 6, in the preferred embodiment, the positioning of the apparatus 10 is critical in relation to the anatomy of the patient, in order to assure that the rump 84 of a typical patient 26, as seen in FIG. 6, would be situated above arcuate portion 82, so that the arcuate portion 82 would substantially span the width of the rump of a patient 26, the reason as will be explained.

As seen in FIG. 5, arcuate portion 82 would define an arcuate indented space 92 of a substantial radial curve, so that a standard bed-pan 94 could be slid into arcuate space 92 as seen in FIG. 5 in phantom view. Therefore, as seen in FIG. 6 as the patient lift chamber 60 is inflated, the arcuate portion 82 would lift rump 90 of the patient, to a height sufficient to allow the positioning of a bed-pan 94 beneath the patient's rump, so that upon elimination of waste by the patient, the bed-pan is in position and would capture any waste eliminated. This is, of course, a vast improvement over the present state of the art as was outlined earlier in this application.

It is foreseen in the preferred embodiment, that the structure of each inflatable leg 68 and 72 would be such that upon maximum inflation, each leg portion 68 and 72 would extend to a gradual inflated portion at the head to a three to four inch inflated rise at the termination points, so that the patient would in effect be lifted from a substantially prone position around the back and shoulder to the uplifted position in that portion of the body resting upon the inflated arcuate portion.

In the preferred embodiment, apparatus 10 could be utilized in hospitals or the like, and could be provided with the source of pressurized air from a common source, so that apparatus 10 could be conveniently used in hospital beds where the pressurized air being allowed to enter each appartus as the need may be, depending on the patient's needs. As is illustrated in the Figures, apparatus 10, upon inflation by the insertion of air into one of the chambers, would generally conform to that portion of the patient's body in contact with the wall of the chamber, thus providing a more comfortable and complete support as the patient is being turned during operation. Apparatus 10, in the preferred embodiment, would be constructed of a very flexible air tight material, and would be capable of being a very minimum thickness in the deflated state so as to cause a little discomfort to the user as possible.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An appaaratus for lifting the rump of a bedridden person to a height above a bed in order to position a bed pan beneath the rump of the person, the apparatus comprising:

(a) a first leg portion extending substantially along a first side perimeter border of a bed a distance between the head and the rump of the individual;

(b) a second leg portion resting upon a second side perimeter border of the bed, also extending the distance between the head of the rump and the bed-ridden person, the first and second leg portions in parallel relationship;

(c) an arcuate inflatable portion joined to the first and second leg portions at the rump area of the bed-ridden patient, the arcuate positioned beneath the rump of the bed-riddened person, and defining a semi-circular space between the leg portions parallel for placement of a bed pan therebeneath when the arcuate portion is inflated;

(d) means for inflating the parallel leg portions, the inflated leg portions defining a border on either side of the patient's upper torso, and the arcuate portion further defining means for raising the rump of the bedridden person to a height sufficient to slip a bed pan beneath the rump of the patient; and (e) a pair of parallel inflatable portions together spanning substantially the width of the bed, and positioned beneath the first and second leg portions and the arcuate inflatable portion and lying along the length of the bed, so that as one of the parallel inflatable portions is inflated, that patient is raised and rotated as the inflatable portion is inflated.

2. An assist apparatus placed on a bed beneath the torso of a bedridden person, for providing rotation of the patient from side to side, or raising the rump of the patient above the bed in order to place a bed pan beneath the patient, the apparatus comprising:

(a) first and second inflatable chambers positioned in parallel relationship along the length of the bed substantially at the upper torso portion of the patient for providing rotation of the patient from side to side as each of the first or second chambers is selectively inflated;

(b) a third inflatable chamber further comprising:

(i) a first leg portion, extending substantially along a first side perimeter border of the bed a distance between the head and the rump of the individual;

(ii) a second leg portion defining a second perimeter border of the bed, also extending the distance between the head and the rump of the bedridden person;

(iii) an arcuate inflatable portion joined to the first and second leg portions, at the rump area of the bedridden patient, the arcuate portion positioned between the rump of the bedridden person and the bed, and defining a semi-circular space between the leg portions for placement of a bed pan therebeneath when the arcuate portion is inflated; and (c) means for inflating the parallel leg portions, the inflated leg portions defining a border on either side of the patient's upper torso, and the arcuate portion further defining means for raising the rump of the bedridden person to a height sufficient to slip a bed pan between the rump of the patient and the bed.

* * * * *

UNITED STATES PATENT AND TRADEMARK OFFICE

CERTIFICATE OF CORRECTION

PATENT NO. : 4,977,629

DATED : DECEMBER 18, 1990

INVENTOR(S) : BETTY L. JONES

It is certified that error appears in the above-identified patent and that said Letters Patent is hereby corrected as shown below:

On the title page, item [76]
INVENTOR SHOULD READ:

--BETTY L. JONES--

Signed and Sealed this

Seventh Day of September, 1993

Bruce Lehman

*Attest:*

BRUCE LEHMAN

*Attesting Officer*

*Commissioner of Patents and Trademarks*